US006820690B2

(12) United States Patent
Vercaemer et al.

(10) Patent No.: US 6,820,690 B2
(45) Date of Patent: Nov. 23, 2004

(54) TECHNIQUE UTILIZING AN INSERTION GUIDE WITHIN A WELLBORE

(75) Inventors: Claude Vercaemer, Paris (FR); Hubertus V Thomeer, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 168 days.

(21) Appl. No.: 10/013,114

(22) Filed: Oct. 22, 2001

(65) Prior Publication Data

US 2003/0075323 A1 Apr. 24, 2003

(51) Int. Cl.[7] ..... E21B 29/00

(52) U.S. Cl. ..... 166/277; 166/73; 166/320; 166/387; 166/50; 166/117.6

(58) Field of Search ..... 166/277, 73, 320, 166/380, 381, 383, 387, 50, 117.6, 278, 65.1

(56) References Cited

U.S. PATENT DOCUMENTS

| | | | | |
|---|---|---|---|---|
| 341,327 | A | | 5/1886 | Fay |
| 2,812,025 | A | | 11/1957 | Teague et al. |
| 3,297,092 | A | | 1/1967 | Jennings |
| 3,353,599 | A | | 11/1967 | Swift |
| 3,419,080 | A | | 12/1968 | Lebourg |
| 3,489,220 | A | | 1/1970 | Kinley |
| 4,266,606 | A | * | 5/1981 | Stone |
| 5,040,283 | A | | 8/1991 | Pelgrom |
| 5,060,737 | A | * | 10/1991 | Mohn |
| 5,348,095 | A | | 9/1994 | Worrall et al. |
| 5,366,012 | A | | 11/1994 | Lohbeck |
| 5,901,789 | A | | 5/1999 | Donnelly et al. |
| 6,029,748 | A | | 2/2000 | Forsyth et al. |
| 6,250,385 | B1 | | 6/2001 | Montaron |
| 6,253,850 | B1 | | 7/2001 | Nazzai et al. |
| 6,296,066 | B1 | * | 10/2001 | Terry et al. |
| 6,301,959 | B1 | | 10/2001 | Hrametz et al. |
| 6,302,199 | B1 | | 10/2001 | Hawkins et al. |
| 6,328,113 | B1 | | 12/2001 | Cook |

* cited by examiner

*Primary Examiner*—Roger Schoeppel
(74) *Attorney, Agent, or Firm*—Robert A. Van Someren PC; Jeffrey E. Griffin; Brigitte Echols

(57) ABSTRACT

A technique for facilitating the use of a variety of completion elements in a wellbore environment. The technique utilizes an insertion guide disposed within an open-hole section of a wellbore. The insertion guide may be radially expanded towards the surrounding formation to remove excess annular space. The expansion of the insertion guide further allows the use of a completion element having a greater diameter than would otherwise be afforded.

36 Claims, 4 Drawing Sheets

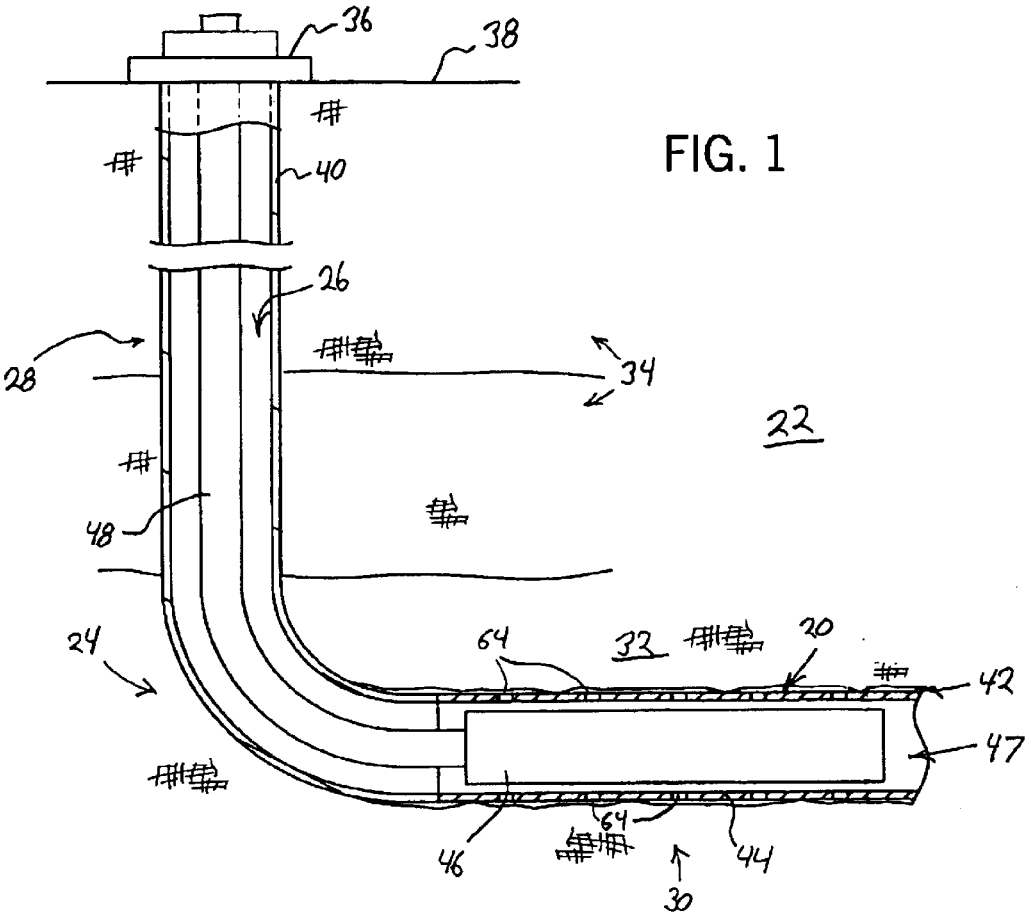
FIG. 1
FIG. 2
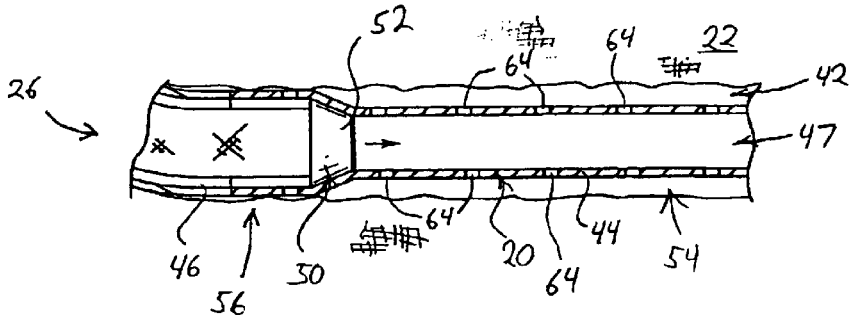

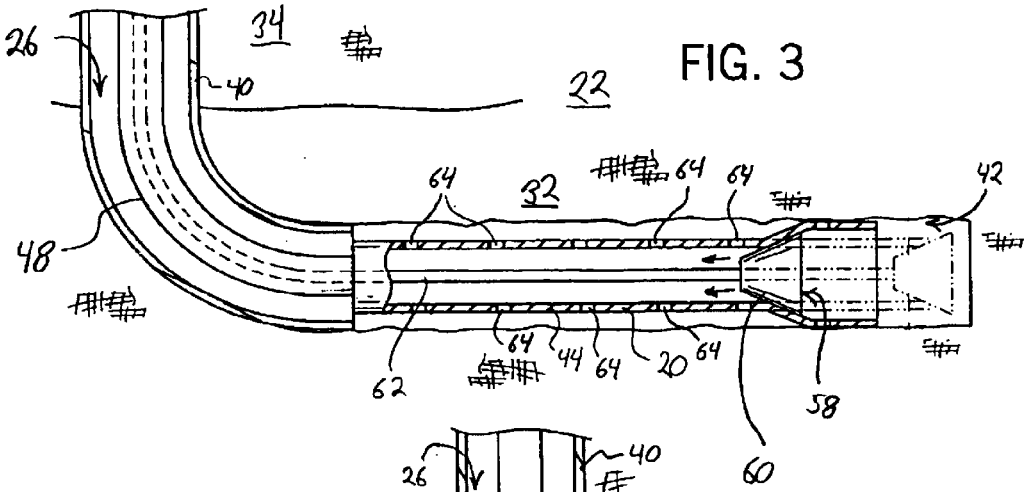
FIG. 3
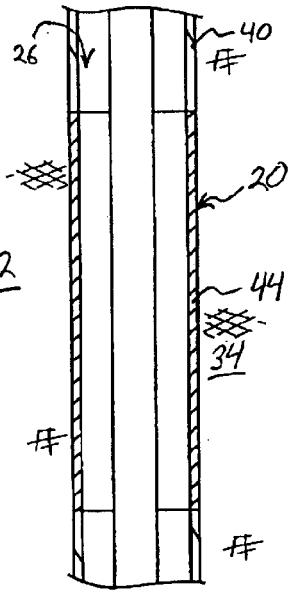
FIG. 4
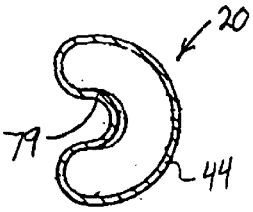
FIG. 8A
FIG. 5
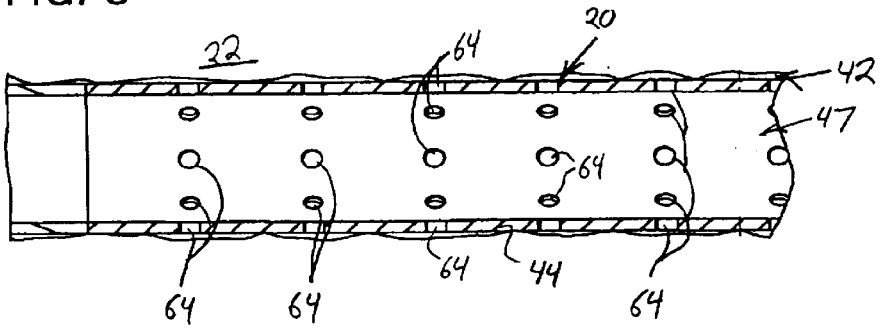

TECHNIQUE UTILIZING AN INSERTION GUIDE WITHIN A WELLBORE

FIELD OF THE INVENTION

The present invention relates generally to the production of reservoir fluids, and particularly to a well construction technique that utilizes an insertion guide placed in an open-hole section of a wellbore.

BACKGROUND OF THE INVENTION

In the conventional construction of wells for the production of petroleum and gas products, a wellbore is drilled through a geological formation to a reservoir of the desired production fluids. For a variety of reasons, e.g. local geology and strength of formation, tortuosity of the well, quality of drilling fluid, diameter of tubing, etc., the usable diameter of the wellbore tends to decrease with depth. Consequently, the suite of casings, liners and/or completion tubulars becomes sequentially smaller in diameter when progressing downhole. The diameter reduction is necessary both to compensate for the narrowing usable space of the wellbore in the open-hole section of the well and to permit insertion of the latest tubular through the previous tubular. In many cases, the diameter of the subsequent tubular element must be at least one and a half inches smaller than the inside diameter of the open-hole section of the well.

The diameter reduction generates an open-flow annulus between the formation or wellbore wall and the tubular component. Generally, this open-flow annulus is undesirable. Outside the reservoir region, the open-flow annular space often is cemented to provide isolation between the formation and the adjacent tubular component. This avoids corrosion of the tubular component, axial migration of liquids and gas along the annulus and other undesirable effects.

Within the reservoir region, hydraulic communication from the formation to the wellbore is necessary for the production of the reservoir fluids. The open-flow annular space can be cemented or kept open. When this annular is cemented, the formation is later put back in communication with the wellbore by perforating the casing and the cement sheath. This technique permits good isolation of different intervals of the reservoir. If this annular is not cemented, we can maximize the contact between the formation and the wellbore but then it becomes much more difficult to get isolation between different intervals. In both cases, cemented or not cemented, the loss of diameter of the completion relative to the diameter of the open hole can be detrimental to maximizing productivity of the well. For example, if the completion is a slotted liner or sand control screen, the necessarily smaller diameter of the liner or screen reduces the section available for flow. Also, as mentioned above, the presence of the open annulus creates difficulty in isolating specific intervals of the formation. As a result, selective sensing of production parameters as well as selective treatment, e.g. stimulation, consolidation or gas and water shut-off, of specific intervals of the formation is difficult, if not impossible. Additionally, in certain wells prone to sand production, the particulates can freely wash along the annulus, repeatedly hitting the completion and causing wear or erosion of the completion.

Because of these problems, most operators continue to cement and perforate casings and liners set in reservoirs so as to allow repair of well problems over the life of the well. Completions, such as slotted liners and screens, are only used in cases where production problems are not anticipated or where cost is an issue. Some attempts have been made to minimize diameter reduction from one piece of tubular to the next and to eliminate or reduce the open annulus without resorting to cementing, but the attempts have met with limited success.

For example, one method is to simply improve the drilling and well conditions to minimize diameter reduction. Such improvement may include controlling the well trajectory and selecting high performance muds. Although this approach may slightly reduce the size of the open annulus surrounding the completion, a substantial open annulus still remains.

Another attempt to alleviate the problems of diameter reduction and open annulus involves drilling new sections of the wellbore with a larger diameter than the previous tubular. This can be achieved with a bi-center bit, for example. With the increased diameter of the subsequent wellbore portion, the next succeeding section of tubular can be provided with an outside diameter very close to the inside diameter of the previous tubular. However, the open-flow annulus in the open-hole section of the wellbore still remains.

More recently, expandable tubular completions have been introduced. In this approach, a tubular completion is inserted into an open-hole section of the wellbore in a reduced diameter form. The completion is then expanded against the formation, i.e. against the open-hole sides of the wellbore. This approach helps alleviate the diameter reduction problem as well as the problem of open-flow annular space. However, in some applications additional problems can arise. If the well is not in good gauge, for example, there can still be communication of well fluids external of the tubular completion. There may also be limits on the types of completions that may be utilized.

SUMMARY OF THE INVENTION

The present invention features a technique for reducing or eliminating the diameter reduction and annular space problems without incurring the difficulties of previously attempted solutions. The technique utilizes an insertion guide that is introduced into an open-hole section of the wellbore. The insertion guide is moved through the wellbore in a contracted state. Once placed in its desired location, the insertion guide is expanded, e.g. deformed, radially outwardly at least partially against the formation, i.e. against the wall of the wellbore. Subsequent to expansion of the insertion guide, a final completion element, e.g. a tubular completion component, is deployed within the insertion guide.

Typically, the outside diameter of the completion element is selected such that it is nearly equal to the inside diameter of the insertion guide subsequent to expansion. Thus, the outside diameter of the completion element diameter is nearly equal the nominal inside diameter of the open-hole reduced only by the thickness of the wall of the insertion guide. Consequently, the completion element is readily removable while having a larger diameter than otherwise possible. Additionally, the detrimental annular space is substantially if not completely eliminated.

BRIEF DESCRIPTION OF THE DRAWINGS

The invention will hereafter be described with reference to the accompanying drawings, wherein like reference numerals denote like elements, and:

FIG. 1 is a front elevational view of an exemplary insertion guide system disposed within a wellbore;

FIG. 2 is a front elevational view of the insertion guide of FIG. 1 being expanded at a desired location;

FIG. 3 is a front elevational view similar to FIG. 2 but showing an alternate technique for expansion;

FIG. 4 is a front elevational view of an expanded insertion guide having a solid wall;

FIG. 5 is a front elevational view of an expanded insertion guide having multiple openings for fluid flow therethrough;

FIG. 8A is a cross-sectional view illustrating another alternate embodiment of the insertion guide;

DETAILED DESCRIPTION OF EXEMPLARY EMBODIMENTS

Figure 6:
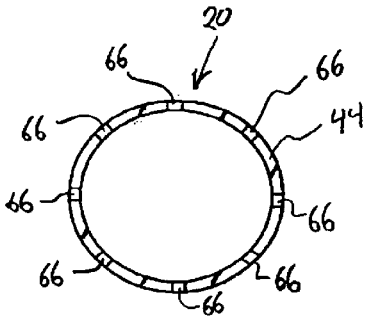
FIG. 6 is a cross-sectional view of an exemplary insertion guide.

The present technique utilizes an insertion guide that may be introduced into a variety of subterranean environments. Typically, the insertion guide is deployed through a wellbore while in a reduced diameter state. The insertion guide is then expanded against the formation at a desired location to permit insertion of a final completion with a full size diameter.

Referring generally to FIG. 1, an exemplary insertion guide 20 is illustrated in an expanded state deployed in a subterranean, geological formation 22. In the illustrated embodiment, the insertion guide 20 is utilized in a well 24 accessed by a wellbore 26. The exemplary wellbore 26 comprises a generally vertical section 28 and a lateral section 30. Insertion guide 20 can be placed at a variety of locations along wellbore 26, but an exemplary location is in a reservoir or reservoir region 32 to facilitate the flow of desired production fluids into wellbore 26. Non-reservoir regions 34 also exist in subterranean formation 22.

In many applications, wellbore 26 extends into subterranean formation 22 from a wellhead 36 disposed generally at a formation surface 38. The wellbore extends through subterranean formation 22 to reservoir region 32. Furthermore, wellbore 26 typically is lined with one or more tubular sections 40, such as a liner.

Typically, insertion guide 20 is disposed in an open-hole region 42 of wellbore 26 subsequent to tubular sections 40. In other applications, the insertion guide can be placed within a cased wellbore. Thus, when insertion guide 20 is expanded, e.g. deformed to its expanded state, an insertion guide sidewall 44 is effectively moved radially outwardly to reduce the annular space between the insertion guide 20 and the formation in open-hole region 42 or cased wellbore section. In one typical application, the insertion guide 20 is expanded outwardly to abut against the formation, thereby minimizing annular space as more fully described below.

Upon expansion of insertion guide 20, a final completion 46 is inserted into an interior 47 of the insertion guide, as illustrated in FIG. 1. Although a gap between final completion 46 and the interior of insertion guide 20 is illustrated in FIG. 1 to facilitate explanation, the final completion can and often will have an outside diameter that is very close in size to the inside diameter of insertion guide 20. Consequently, very little annular space exists between final completion element 46 and insertion guide 20. The final completion 46 may be deployed by a variety of known mechanisms, including a deployment tubing 48. Other mechanisms comprise cable, wireline, drill pipe, coiled tubing, etc.

Expansion of insertion guide 20 at a desired location within wellbore 26 can be accomplished in several different ways. As illustrated in FIG. 2, the insertion guide may be connected to a lead end of final completion 46 and delivered to the appropriate open-hole location within wellbore 26. This allows the insertion guide and the internal completion element to be deployed with a single run into the well.

In this embodiment, final completion 46 is coupled to insertion guide 20 by an appropriate coupling mechanism 50. Coupling mechanism 50 may include a sloped or conical lead end 52 to facilitate expansion of insertion guide 20 from a contracted state 54 (see right side of insertion guide 20 in FIG. 2) to an expanded state 56 (see left side of FIG. 2). As the sloped lead end 52 and final completion 46 are moved through insertion guide 20, the entire insertion guide is changed from the contracted state 54 to the expanded state 56. Other coupling mechanisms also may be utilized to expand insertion guide 20, such as bicenter rollers. Expansion also can be accomplished by pressurizing the insertion guide or by relying on stored energy of insertion guide 20.

In an alternate embodiment, as illustrated in FIG. 3, insertion guide 20 is delivered to a desired location within the wellbore during an initial run downhole via deployment tubing 48. The insertion guide 20 is mounted between deployment tubing 48 and a spreader mechanism 58 disposed generally at the lead end of insertion guide 20. Spreader mechanism 50 has a conical or otherwise sloped lead surface 60 to facilitate conversion of insertion guide 20 from its contracted state to its expanded state. As illustrated in FIG. 3, spreader mechanism 58 is pulled through insertion guide 20 by an appropriate pulling cable 62 or other mechanism. Once spreader mechanism 58 is pulled through insertion guide 20, the spreader mechanism 58 is retrieved through wellbore 26, and final completion 46 is deployed within the expanded insertion guide during a second run into the well.

Insertion guide 20 may be formed in a variety of sizes, shapes, cross-sectional configurations and wall types. For example, insertion guide sidewall 44 may be a solid wall, as illustrated in FIG. 4. A solid-walled insertion guide 20 typically is used in a non-reservoir region, such as one of the non-reservoir regions 34. In a reservoir region, such as region 32, insertion guide 20 typically comprises a plurality of flow passages 64, as best illustrated in FIG. 5. Flow passages 64 permit fluid, such as the desired production fluid, to flow from reservoir region 32 through insertion guide 20 and into wellbore 26. Illustrated flow passages 64 are radially oriented, circular openings, but they are merely exemplary passages and a variety of arrangements and configurations of the openings can be utilized. Additionally, the density and number of openings can be adjusted for the specific application.

Figure 7:
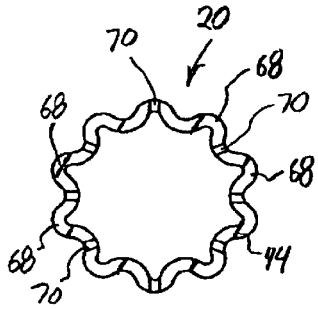
FIG. 7 is a cross-sectional. view illustrating an alternate embodiment of the insertion guide.
Figure 8:
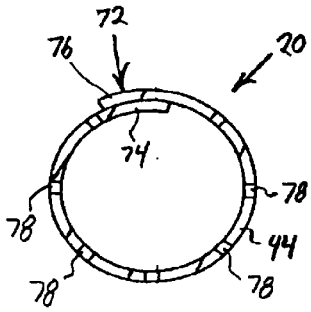
FIG. 8 is a cross-sectional view illustrating another alternate embodiment of the insertion guide.

Expandability of insertion guide 20 may be accomplished in a variety of ways. Examples of cross-sectional configurations amenable to expansion are illustrated in FIGS. 6, 7 and 8. As illustrated specifically in FIG. 6, the insertion guide sidewall 44 comprises a plurality of openings 66 that become flow passages 64, e.g. radial flow passages, upon expansion. In this embodiment, openings 66 are formed along the length of insertion guide 20 and upon deforming of insertion guide 20, the openings 66 are stretched into broader openings. The configuration of slots 66 and the resultant openings 64 may vary substantially. For example, openings 66 may be in the form of slots, holes or a variety of geometric or asymmetric shapes.

In an alternate embodiment, sidewall 44 is formed as a corrugated or undulating sidewall, as best illustrated in FIG. 7. The corrugation allows insertion guide 20 to remain in a contracted state during deployment. However, after reaching a desired location, an appropriate expansion tool is moved through the center opening of the insertion guide forcing the sidewall to a more circular configuration. This deformation again converts the insertion guide to an expanded state. The undulations 68 typically extend along the entire circumference of sidewall 44. Additionally, a plurality of slots or openings 70 may be formed through sidewall 44 to permit fluid flow through side wall 44.

Another exemplary embodiment is illustrated in FIG. 8. In this embodiment, sidewall 44 comprises an overlapped region 72 having an inner overlap portion 74 and an outer overlap portion 76. When outer overlap 76 lies against inner overlap 74, the insertion guide 20 is in its contracted state for introduction through wellbore 26. Upon placement of the insertion guide at a desired location, an expansion tool is moved through the interior of insertion guide 20 to expand the sidewall 44. Essentially, inner overlap 74 is slid past outer overlap 76 to permit formation of a generally circular, expanded insertion guide 20. As with the other exemplary embodiments, this particular embodiment may comprise a plurality of slots or openings 78 to permit the flow of fluids through sidewall 44.

In FIG. 8A, another embodiment is illustrated in which a portion 79 of sidewall 44 is deformed radially inward in the contracted state to form a generally kidney-shaped cross-section. When this insertion guide is expanded, portion 79 is forced radially outward to a generally circular, expanded configuration.

Figure 9:
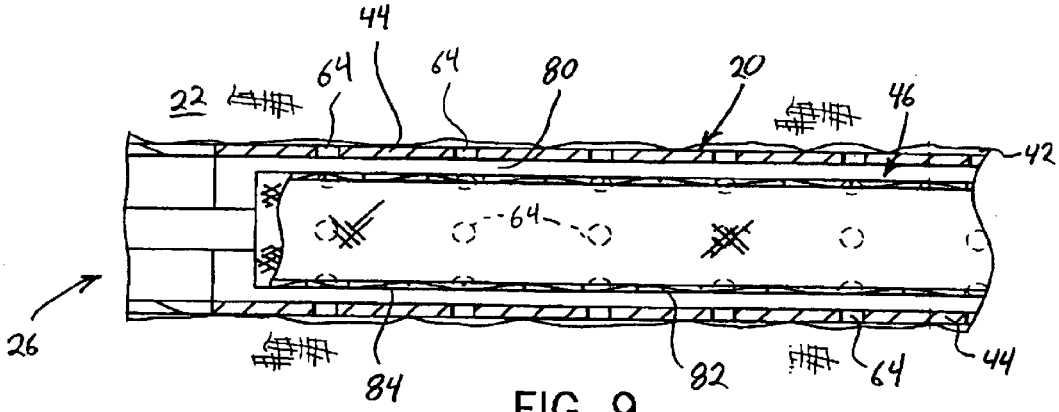
FIG. 9 is a front elevational view of an insertion guide having a sand screen completion element disposed therein.

Many types of final completions can be used in the present technique. For example, various tubular completions, such as liners and sand screens may be deployed within an interior 80 of the expanded insertion guide 20. In FIG. 9, a sand screen 82 is illustrated within interior 80. This type of completion generally comprises a filter material 84 able to filter sand and other particulates from incoming fluids prior to production of the fluids. Because of the expandable insertion guide, the sand screen 82 may have a full size diameter while retaining its ability to be removed from the wellbore. Additionally, the risk of damaging sand screen 82 during installation is minimized, and the most advanced filter designs can be inserted because there is no requirement for expansion of the sand screen itself.

Figure 10:
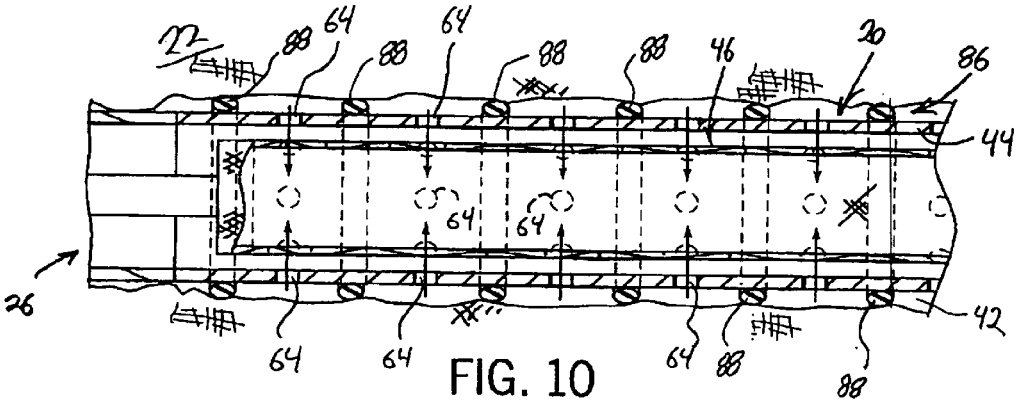
FIG. 10 is a front elevational view of an insertion guide having an external axial flow inhibitor.
Figure 11:
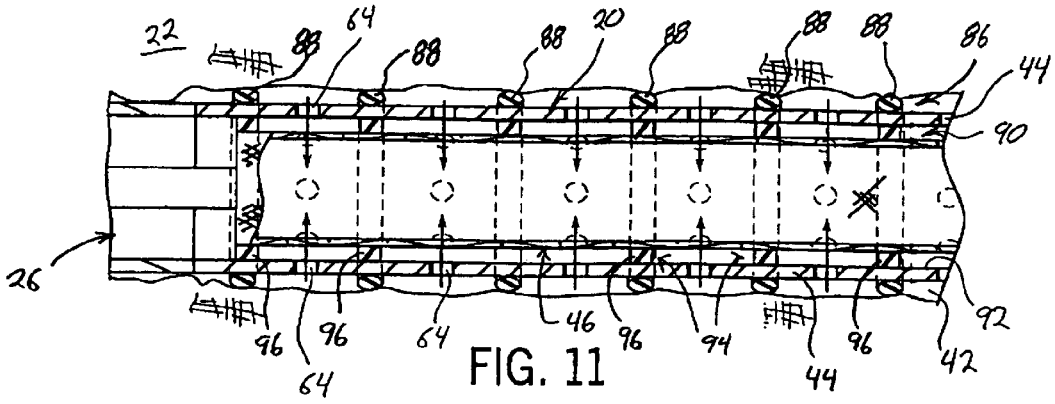
FIG. 11 is a view similar to FIG. 10 but showing an internal axial flow inhibitor.

In some environments, it may be desirable to compartmentalize the reservoir region 32 along insertion guide 20. As illustrated in FIG. 10, an axial flow inhibitor 86 is combined with insertion guide 20. Axial flow inhibitor 86 is designed to act between insertion guide sidewall 44 and geological formation 22, e.g., the open-hole wall of wellbore 26 proximate insertion guide 20. Inhibitor 86 limits the flow of fluids in an axial direction between sidewall 44 and formation 22 to allow for better sensing and/or control of a variety of reservoir parameters, as discussed above.

In the embodiment illustrated, axial flow inhibitor 86 comprises a plurality of seal members 88 that extend circumferentially around insertion guide 20. Seal members 88 may be formed from a variety of materials including elastomeric materials, e.g. polymeric materials injected through sidewall 44. Additionally, seal members 88 and/or portions of sidewall 44 can be formed from swelling materials that expand to facilitate compartmentalization of the reservoir. In fact, the insertion guide 20 may be made partially or completely of swelling materials that contribute to a better isolation of the wellbore. Also, axial flow inhibitor 86 may comprise fluid based separators, such as Annular Gel Packs available from Schlumberger Corporation, elastomers, baffles, labyrinth seals or mechanical formations formed on the insertion guide itself.

Additionally or in the alternative, an internal axial flow inhibitor 90 can be deployed to extend radially inwardly from an interior surface 92 of insertion guide sidewall 44. An exemplary internal axial flow inhibitor comprises a labyrinth 94 of rings, knobs, protrusions or other extensions that create a tortuous path to inhibit axial flow of fluid in the typically small annular space between interior surface 92 of insertion guide and the exterior of completion 46. In the embodiment illustrated, labyrinth 94 is formed by a plurality of circumferential rings 96. However, it should be noted that both external axial flow inhibitor 86 and internal axial flow inhibitor 90 can be formed in a variety of configurations and from a variety of materials depending on desired design parameters for a specific application.

Figure 12:
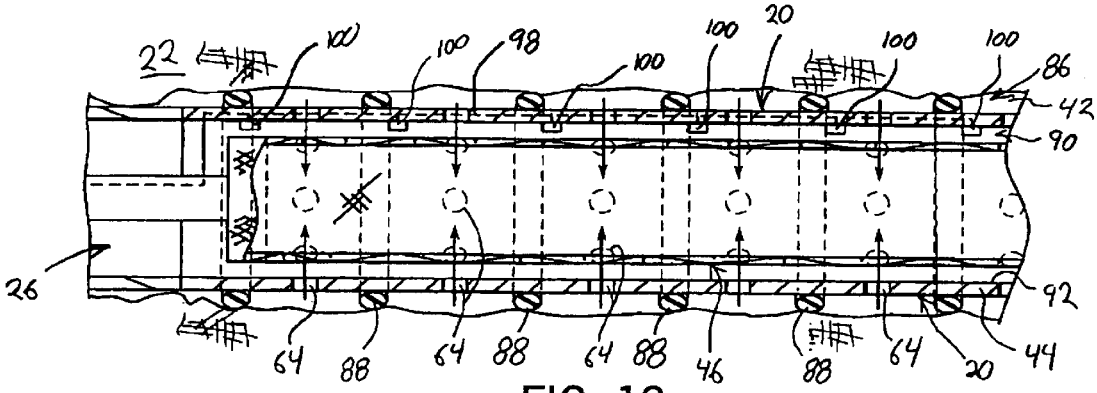
FIG. 12 illustrates an insertion guide having one or more signal communication leads as well as one or more tools, e.g. sensors, incorporated therewith.

Insertion guide 20 also may be designed as a "smart" guide. As illustrated in FIG. 12, an exemplary insertion guide comprises one or more signal carriers 98, such as conductive wires or optical fiber. The signal carriers 98 are available to carry signals to and from a variety of instruments or tools. The instrumentation and/or tools can be separate from or combined with insertion guide 20. In the embodiment illustrated, for example, a plurality of sensors 100, such as temperature sensors, pressure sensors, flow rate sensors etc., are integrated into or attached to insertion guide 20. The sensors are coupled to signal carriers 98 to provide appropriate output signals indicative of wellbore and production related parameters. Additionally, well treatment tools may be incorporated into the system to selectively treat, e.g. stimulate, the well.

Depending on the type of completion and deployment system, signal carriers 98 and the desired instrumentation and/or tools can be deployed in a variety of ways. For example, if the signal carriers, instrumentation or tools tend to be components that suffer from wear, those components may be incorporated with the completion and/or deployment system. In one implementation, instruments are deployed in or on the insertion guide and coupled to signal carriers attached to or incorporated within the completion and deployment system. The coupling may comprise, for example, an inductive coupling. Alternatively, the instrumentation and/or tools may be incorporated with the completion and designed for communication through signal carriers deployed along or in the insertion guide 20. In other embodiments, the signal carriers as well as instrumentation and tools can be incorporated solely in either the insertion guide 20 or the completion and deployment system. The exact configuration depends on a variety of application and environmental considerations.

Figure 13:
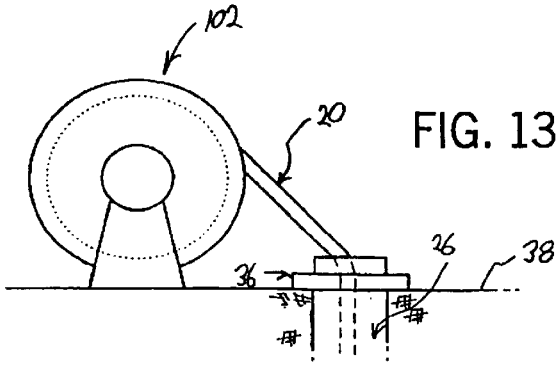
FIG. 13 is a diagrammatic illustration of one technique for deploying the insertion guide into a wellbore while in its contracted state.

Referring generally to FIG. 13, one exemplary way of introducing insertion guide 20 into a wellbore in its contracted state is via a reel 102. The use of a reel 102 is particularly advantageous when relatively long sections of insertion guide are introduced into wellbore 26. Reel 102 can be designed similar to reels used in the deployment and retrieval of coiled tubing. With such designs, the insertion guide is readily unrolled into wellbore 26. Reel 102 also permits retrieval of insertion guide 20, if necessary, prior to expansion of the guide at its desired wellbore location.

It should be understood that the foregoing description is of exemplary embodiments of this invention, and that the invention is not limited to the specific forms shown. For example, the insertion guide may be made in various lengths and diameters; the insertion guide may be designed with differing degrees of expandability; a variety of completion components may be deployed within the insertion guide; the insertion guide may comprise or cooperate with a variety of tools and instrumentation; and the mechanisms for expanding the insertion guide may vary, depending on the particular application and desired design characteristics. These and other modifications may be made in the design and arrangement of the elements without departing from the scope of the invention as expressed in the appended claims.

What is claimed is:

1. A system for use in a wellbore, comprising:

an insertion guide disposed within an open-hole section of a formation, the insertion guide being radially expanded at least partially against the formation; and a completion component deployed within the insertion guide, the completion component having an outside diameter substantially close in size to an inside diameter of the insertion guide when the insertion guide is radially expanded.

2. The system as recited in claim 1, wherein the completion component is removably deployed.

3. The system as recited in claim 1, further comprising an axial flow inhibitor to limit axial flow of a fluid between the completion component and the insertion guide.

4. The system as recited in claim 1, wherein the axial flow inhibitor comprises a labyrinth.

5. The system as recited in claim 3, wherein the insertion guide comprises a plurality of radial openings to permit generally radial fluid flow therethrough.

6. The system as recited in claim 1, further comprising at least one seal member disposed circumferentially about an exterior of the insertion guide to inhibit axial fluid flow.

7. The system as recited in claim 6, wherein the at least one seal member comprises a plurality of rings extending radially outwardly from the exterior of the insertion guide.

8. The system as recited in claim 6, wherein the at least one seal member comprises a swelling material.

9. The system as recited in claim 1, wherein the completion component comprises a completion tubular.

10. The system as recited in claim 1, wherein the completion component comprises a sand screen.

11. The system as recited in claim 1, wherein the completion component comprises a liner.

12. The system as recited in claim 11, wherein the liner comprises a slotted liner.

13. The system as recited in claim 1, further comprising a signal carrier.

14. The system as recited in claim 13, further comprising a sensor coupled to the signal carrier.

15. The system as recited in claim 14, wherein the signal carrier is coupled to the insertion guide.

16. The system as recited in claim 14, wherein the signal carrier is coupled to the completion component.

17. The system as recited in claim 1, wherein the insertion guide comprises a solid-walled section disposed within a wellbore and outside of a production fluid reservoir.

18. A method of utilizing a wellbore disposed within a formation, comprising:

deploying an insertion guide within the wellbore in a contracted state;

arranging axial flow inhibitors between the insertion guide and the wellbore, the axial flow inhibitors creating a plurality of compartments to direct generally radial flow of fluid into an interior of the insertion guide;

expanding the insertion guide at a desired location within the wellbore to reduce annular space between the insertion guide and the formation; and inserting a completion into the insertion guide.

19. The method as recited in claim 18, wherein expanding comprises forcing the completion into the insertion guide.

20. The method as recited in claim 18, wherein expanding comprises moving an expansion tool through the insertion guide prior to inserting the completion.

21. The method as recited in claim 18, wherein arranging comprises inhibiting axial flow of fluid along the insertion guide via at least three sealing rings.

22. The method as recited in claim 21, further comprising inhibiting axial flow of fluid between the insertion guide and the completion.

23. The method as recited in claim 21, wherein inhibiting axial flow comprises inhibiting axial flow of fluid between the insertion guide and the formation via an arrangement of the swelling materials.

24. The method as recited in claim 18, wherein deploying comprises locating the insertion guide in a lateral wellbore.

25. The method as recited in claim 18, wherein inserting comprises inserting a sand screen.

26. The method as recited in claim 18, further comprising coupling a signal carrier to at least one of the insertion guide and the completion.

27. A method of utilizing a wellbore disposed within a formation, comprising:

locating an insertion guide at an open-hole region of the wellbore;

expanding the insertion guide to reduce annular space surrounding the insertion guide; and utilizing a completion within the insertion guide during production of a fluid from the formation.

28. The method as recited in claim 27, wherein locating comprises locating the insertion guide at a lateral region of the wellbore.

29. The method as recited in claim 27, wherein locating comprises locating the insertion guide at a vertical region of the wellbore.

30. The method as recited in claim 27, wherein locating comprises locating an insertion guide, having a plurality of flow-through passages, within a production fluid reservoir.

31. The method as recited in claim 27, wherein locating comprises locating a solid-walled insertion guide within a formation.

32. The method as recited in claim 27, further comprising inhibiting axial flow of fluid along the insertion guide.

33. The method as recited in claim 32, wherein inhibiting axial flow comprises inhibiting axial flow of fluid between the insertion guide and the completion.

34. The method as recited in claim 32, wherein inhibiting axial flow comprises inhibiting axial flow of fluid between the insertion guide and the formation.

35. The method as recited in claim 27, wherein expanding comprises expanding the insertion guide against the formation.

36. A system of utilizing a wellbore disposed within a formation, comprising:

means for unrolling an extended section of an insertion guide into the wellbore in a contracted state;

means for expanding the insertion guide at a desired location within the wellbore to reduce annular space between the insertion guide and the formation; and means for introducing a completion into the insertion guide.

* * * * *